US005527091A

United States Patent [19]

Gruber

[11] Patent Number: 5,527,091

[45] Date of Patent: Jun. 18, 1996

[54] REFRESHMENT ACCOMMODATING SEAT CUSHION

[76] Inventor: Baylis M. Gruber, P.O. Box 1341, Cape Coral, Fla. 33910

[21] Appl. No.: 407,181

[22] Filed: Mar. 21, 1995

[51] Int. Cl.[6] ..... A47C 7/18

[52] U.S. Cl. ..... 297/188.01; 297/219.1; 297/188.08; 5/653; 5/656; 40/320

[58] Field of Search ..... 5/481, 653, 464, 5/462, 907, 471, 473; 297/219.1, 188.01, 188.08; 40/320

[56] References Cited

U.S. PATENT DOCUMENTS

| | | | |
|---|---|---|---|
| 336,200 | 6/1993 | Merritt | 5/653 X |
| 2,659,418 | 11/1953 | Berman | 5/481 X |
| 3,151,909 | 10/1964 | Gerdetz | 297/183.5 X |
| 3,323,152 | 6/1967 | Lerman | 297/452.57 X |
| 4,486,493 | 12/1984 | Burmester et al. | 5/481 X |
| 4,544,598 | 10/1985 | Meiller et al. | 5/481 X |
| 4,637,151 | 1/1987 | Love et al. | 5/481 X |
| 4,996,721 | 3/1991 | Beshro | 297/219.1 X |
| 5,221,273 | 6/1993 | Graham | 604/358 |
| 5,397,162 | 3/1995 | Huang | 40/320 X |
| 5,429,852 | 7/1995 | Quinn | 5/471 X |

*Primary Examiner*—Peter M. Cuomo
*Assistant Examiner*—Stephen Vu
*Attorney, Agent, or Firm*—William E. Noonan

[57] ABSTRACT

A refreshment accommodating seat cushion apparatus is disclosed. A pair of oppositely facing padded sections are disposed about an intermediate relatively rigid support element. Receptacles are formed through one of the padded sections for accommodating, one refreshment container. The seat cushion selectively encases a generally horizontal seat surface such that a first padded section faces and touches the seat surface and the other padded section faces upwardly from the seat surface.

17 Claims, 3 Drawing Sheets

REFRESHMENT ACCOMMODATING SEAT CUSHION

FIELD OF THE INVENTION

This invention relates to a refreshment accommodating seat cushion and, more particularly, to a portable seat cushion that may be used to hold and transport snacks and beverages.

BACKGROUND OF THE INVENTION

Spectators attending sporting events, concerts and other stadium activities often partake in snacks, beverages and other refreshments. It is not uncommon for the spectator to leave his or her seat and travel to a centrally located vendor or concession stand to purchase such items. Transporting the refreshments back to the seat can be quite inconvenient and annoying. Obviously, the size and number of food and beverage items that one person can carry in his or her hands is limited. Some concession stands provide the fan or spectator with a flimsy cardboard holder. However, such holders are not very strong and are usually limited to carrying relatively few items. In a crowded stadium with narrow walkways, refreshments are commonly dropped and spilled.

Transporting refreshments from a vendor or concession stand back to one's seat is made even more difficult when the spectator is carrying a conventional portable seat cushion. Such cushions are often used to make the rigid seat surfaces normally found at sports arenas more comfortable. In crowded public settings, such as stadiums and arenas, the spectator may not be able to leave the seat cushion behind when he or she visits a concession stand because the cushion may be stolen. Accordingly, the spectator is forced to either leave the cushion with a companion or to carry the cushion to the vendor. If the person is required to transport both the cushion and refreshments back to his or her seat, there is a good chance that at least some item will spill. Moreover, when the spectator finally arrives at his seat, he usually has to either hold the refreshments in his hands or place them on his lap. In a crowded venue with limited seat size, there is again a good chance that food or drink will drop or spill. At present, there is no convenient and reliable means for transporting and holding the refreshments so that they are not spilled.

Not only do conventional seat cushions interfere with the transportation of refreshment items, they often exhibit a fairly thin, flimsy construction. As a result, relatively poor comfort and support are provided. Over time, the cushion breaks down and becomes even less supportive.

SUMMARY OF INVENTION

It is therefore an object of this invention to provide a sturdy and comfortable portable seat cushion that may be used as a tray for carrying and holding refreshments.

It is a further object of this invention to provide a refreshment accommodating seat cushion that is durable and resistant to food and drink stains.

It is a further object of this invention to provide a seat cushion apparatus that may carry a wide variety of attractive and entertaining logos, slogans and other indicia.

It is a further object of this invention to provide a refreshment accommodating seat cushion that is lightweight and easily transportable.

It is a further object of this invention to provide a portable seat cushion that provides improved support and comfort for a user who is required to sit for an extended period of time.

It is a further object of this invention to provide a refreshment accommodating seat cushion that securely holds a wide variety of food and beverage items so that they may be transported from a concession stand or vendor to a seat and held securely at the seat location without spilling.

This invention results from a realization that a portable seat cushion may be provided with a variety of pre-formed openings to accommodate food and drink beverage items. This invention results from the further realization that such a cushion will provide improved support and comfort and will comprise a stronger tray by employing a pair of padded sections on either side of a rigid central member. Only one of the padded sections includes openings for accommodating refreshment items. The other is preferably solid to provide improved comfort and support for the user.

This invention features a refreshment accommodating seat cushion apparatus including means defining a cushion having a pair of oppositely facing padded sections and a relatively rigid support element disposed within the cushion between the padded sections. There are receptacle means formed in the cushion through a first one of the padded sections for accommodating at least one refreshment container. The seat cushion is selectively engaged with a generally horizontal seat surface, such that the first padded section faces and touches the seat surface and the other padded section faces upwardly from the seat surface.

In a preferred embodiment each padded section includes a resilient substance. This may be composed of a closed cell foam element. The cushion may further include means defining a flexible covering formed over the foam elements. The flexible covering may comprise a plastic sheet-like material. The covering may alternatively comprise a fabric and a liquid resistant sheet formed over the fabric. The covering may include indicia printed on either the plastic or the fabric. The liquid resistant sheet may be transparent to permit viewing of indicia printed on the fabric. The flexible covering may also line the receptacles.

The support element may include a generally planar configuration. Preferably, the receptacle means are formed exclusively through the first padded section. Means defining a handle may be attached to the cushion. Such a handle is typically distinct from the cushion.

The seat cushion apparatus may also be made without a support element. In such cases the cushion is at least 2½ inches and preferably approximately 3 inches thick. One or more of the receptacles is a minimum of 1½ inches thick to accommodate a drink container. Preferably there is at least 1 inch of padded material beneath each receptacle.

DETAILED DESCRIPTION OF PREFERRED EMBODIMENTS

Other objects, features and advantages will occur from the following description of preferred embodiments and the accompanying drawings, in which.

Figure 1:
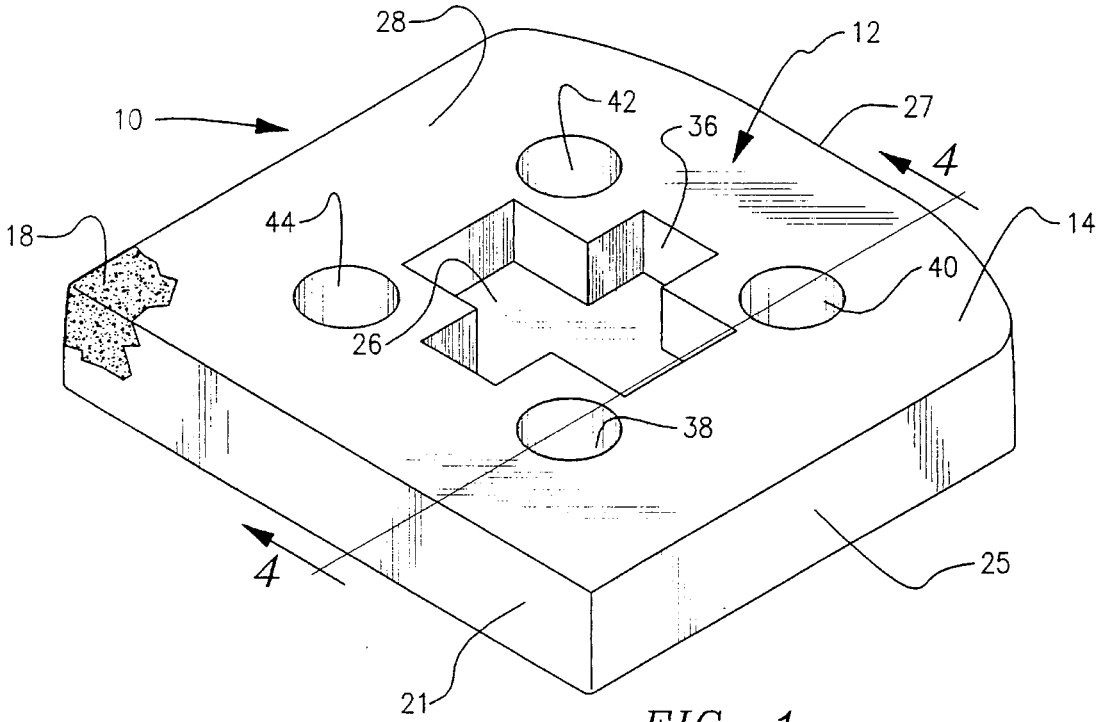
FIG. 1 is a perspective view of a refreshment accommodating seat cushion according to this invention.
Figure 2:
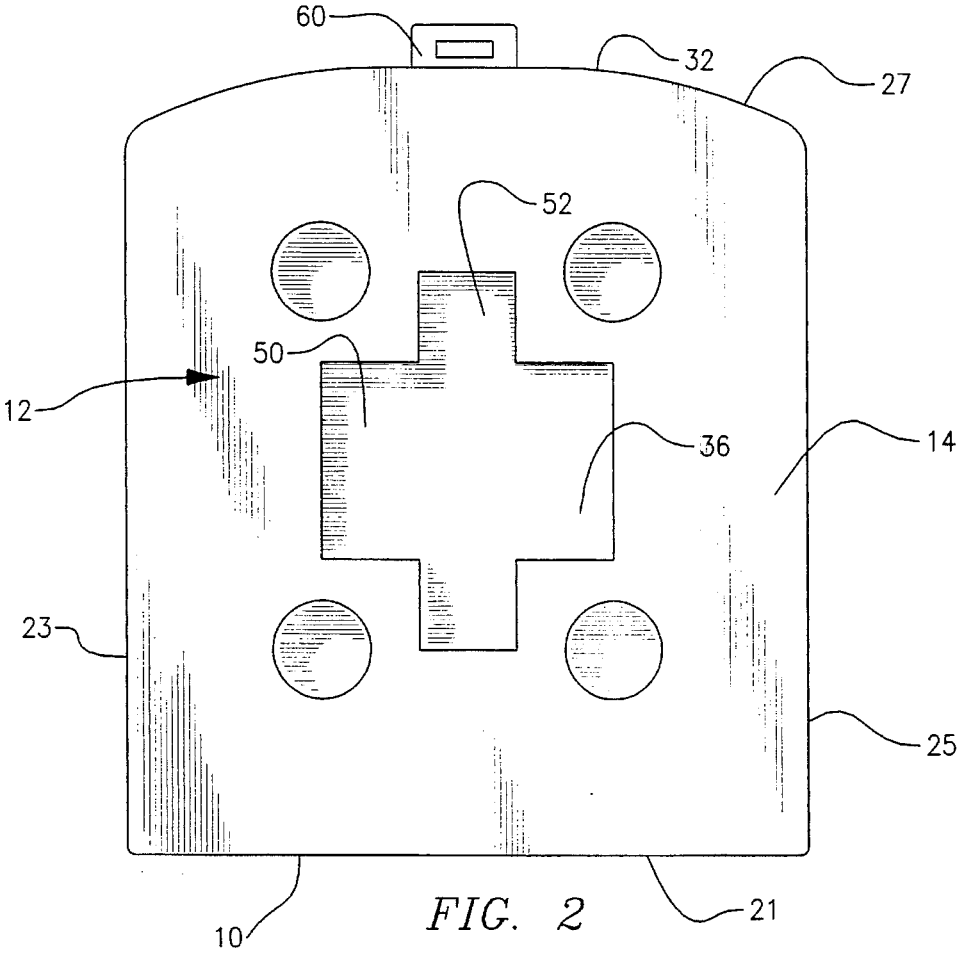
FIG. 2 is a top plan view of the seat cushion illustrating the refreshment accommodating receptacles.
Figure 3:
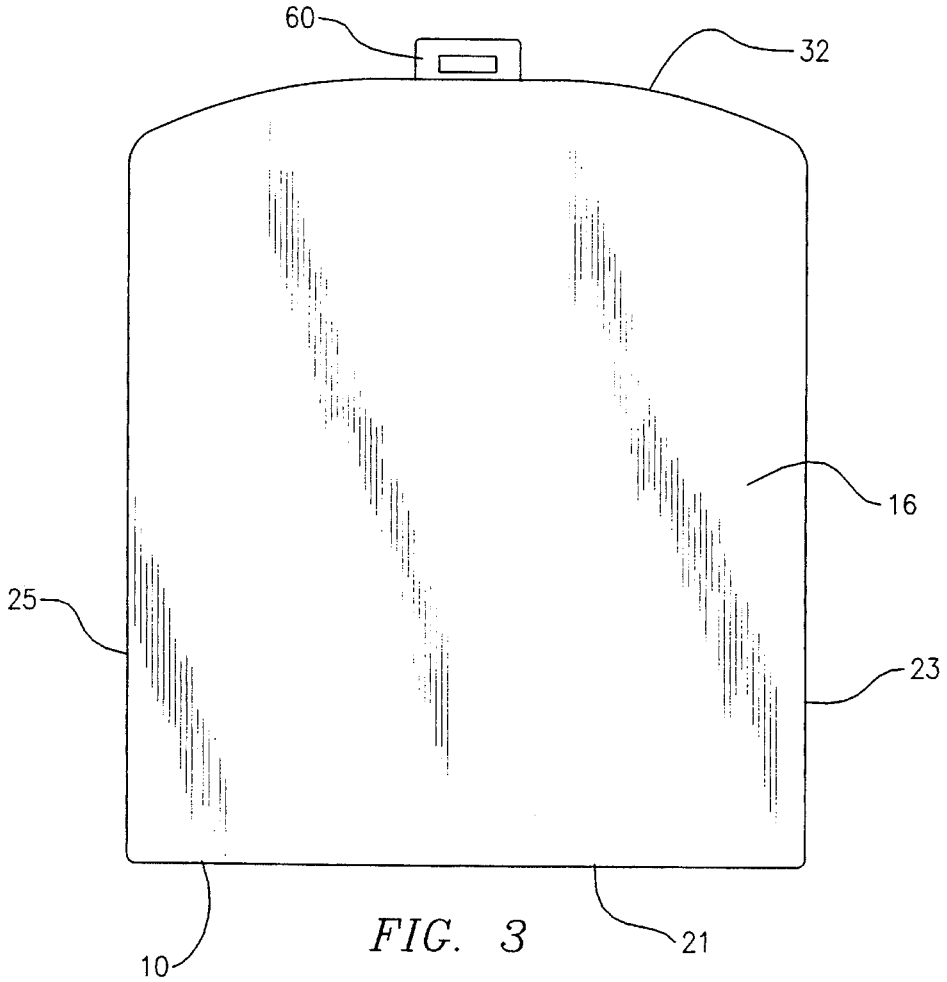
FIG. 3 is a bottom plan view of the cushion apparatus.

There is shown in FIG. 1 a portable seat cushion 10 having a plurality of refreshment accommodating receptacles 12 formed therein. Cushion 10 includes a generally flat upper surface 14, shown alone in FIG. 2 and a flat lower surface 16, shown alone in FIG. 3. As depicted in FIGS. 1–3, the cushion includes a front edge 21, a pair of side edges 23 and 25 and a curved rearward edge 27. In alternative embodiments the cushion may have a perfectly square or rectangular configuration.

As shown in FIG. 1, cushion 10 comprises an inner resilient substance 18, which is typically a closed cell foam, such as urethane, or an analogous padded configuration.

Figure 4:
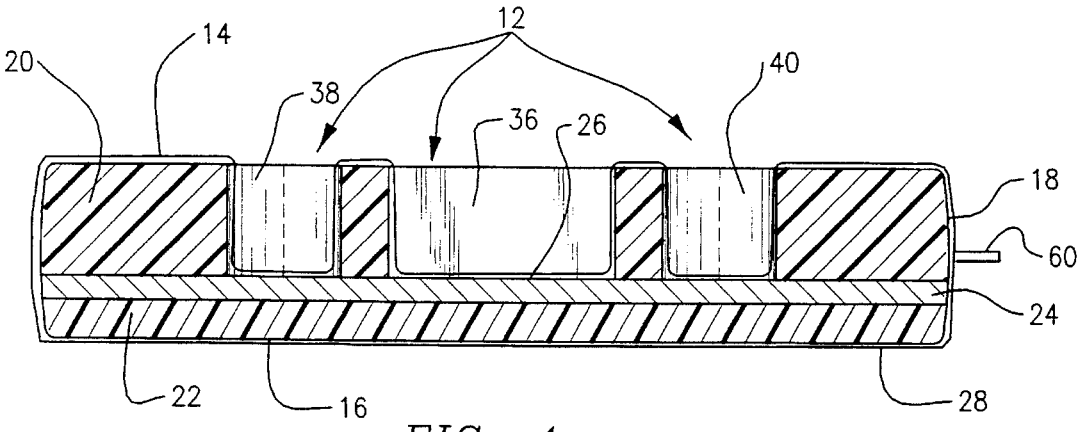
FIG. 4 is a sectional view taken along line 4—4 of FIG. 1.

As shown more particularly in FIG. 4, cushion 10 includes first foam section 20 and a distinct second foam section 22. A relatively rigid planar element 24 is interposed between foam sections 20 and 22 such that the foam sections face in generally opposite directions relative to support element 24. The support element may be composed of wood, plastic, Styrofoam$^{TM}$ or other materials that are rigid relative to the padded foam sections. In certain embodiments, foam sections 20 and 22 may be secured adhesively or otherwise to respective sides of element 24. Alternatively, however, a sheet-like material such as a fabric 26 covers element 24 and the padded foam sections are simply placed against the outer surface of fabric 26 without any adhesive.

Figure 6:
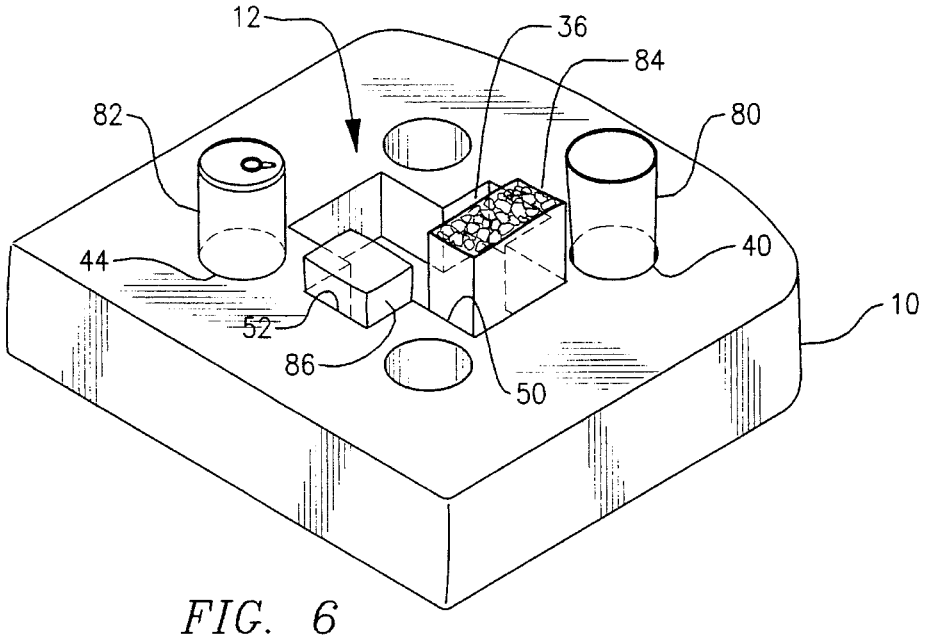
FIG. 6 is a perspective view of the apparatus accommodating a variety of refreshment items.

A thin flexible covering 28, FIGS. 1 and 4, is formed over padded sections 20 and 22 and support element 24. Flexible covering 28 includes a plastic such as vinyl, which is stain resistant and easy to clean. Appropriate indicia may be printed on covering 28. For example, as illustrated in FIG. 6, the logo "Florida State Seminoles" is printed .on the lower surface 16 of cushion 10. In alternative versions, the flexible covering may include an inner fabric that is formed over foam 18 and an outer liquid resistant layer that is wrapped about the fabric. In certain embodiments, various types of indicia such as team names and/or logos may be printed on the inner fabric. In such embodiments, the outer liquid resistant layer preferably comprises a transparent plastic. As a result, the printed indicia is visible through plastic layer 32. At the same time, the liquid resistant plastic repels rain and drink spillage so that the cushion is easily cleaned and the life of the cushion is prolonged. In either embodiment, covering 28 is wrapped entirely about the interior padded sections 20 and 22 and the intermediate support element 24 arid are secured closed by various conventional means such as stitching or adhesives. The outer covering 28 holds the inner padded sections and support element securely in place to define the cushion apparatus.

Receptacles 12, shown in FIGS. 1, 2 and 4, comprise a central, generally X-shaped opening 36 and four cylindrical shaped openings 38, 40, 42 and 44. As best shown in FIG. 4, each of receptacles 12 is formed exclusively through padded section 20. Receptacles 38, 40, 42 and 44 are shaped for receiving beverage containers such as cups and cans. X-shaped receptacle 36 is designed for receiving various food and snack items, including popcorn, candy, hamburgers, hot dogs, etc. As shown in FIG. 2, receptacle 36 includes a relatively wide portion 50 and a relatively narrow portion 52. This provides varying widths so that various sizes of food containers may be snugly received within receptacle 36. As illustrated in FIGS. 1 and 4, the flexible covering 28 preferably lines the interior walls of receptacles 12 as well as the floors of the receptacles, which are defined by element 24. In alternative embodiments, the interior walls, are not covered and only planar surfaces 14 and 16 and edges 21, 23, 25 and 27 are lined.

As best shown in FIGS. 3 and 4, padded section 22 and the portion of covering 28 that extends over section 22 are solid and do not contain receptacles. This side 16 of cushion apparatus 10 serves as the surface of the seat cushion that faces upwardly to engage the user when the apparatus is placed on a seat. Improved support and comfort are achieved if no receptacles are formed in surface 16. However, in alternative embodiments, one or more receptacles may be formed in seat surface 16, as well.

Cushion 10 has an overall thickness of at least 2½ inches and preferably approximately 3 inches. The padded portion 20 is preferably about 1½–2 inches thick so that receptacles 12 have that depth. The underlying padded portion 22 has a preferred thickness of about 1–1½ inches. As a result, apparatus 10 provides comfortable support for a spectator and exhibits improved rigidity when used as a tray. In certain embodiments the x-shaped receptacle is slightly shallower than the cup receptacles 38–44. The latter require greater depth to provide improved support for beverage containers.

As best shown in FIGS. 2 and 3, a handle 60 is secured to cushion 10. Handle 60 may comprise a plastic handle that is attached unitarily or otherwise to exterior plastic covering 32. Alternatively, handle 60 may be attached in other manners such as to the inner fabric 30 or to the inner resilient padding 18, shown in FIG. 1. Handle 60 permits cushion 10 to be conveniently transported to and from the location where it is to be used.

Figure 5:
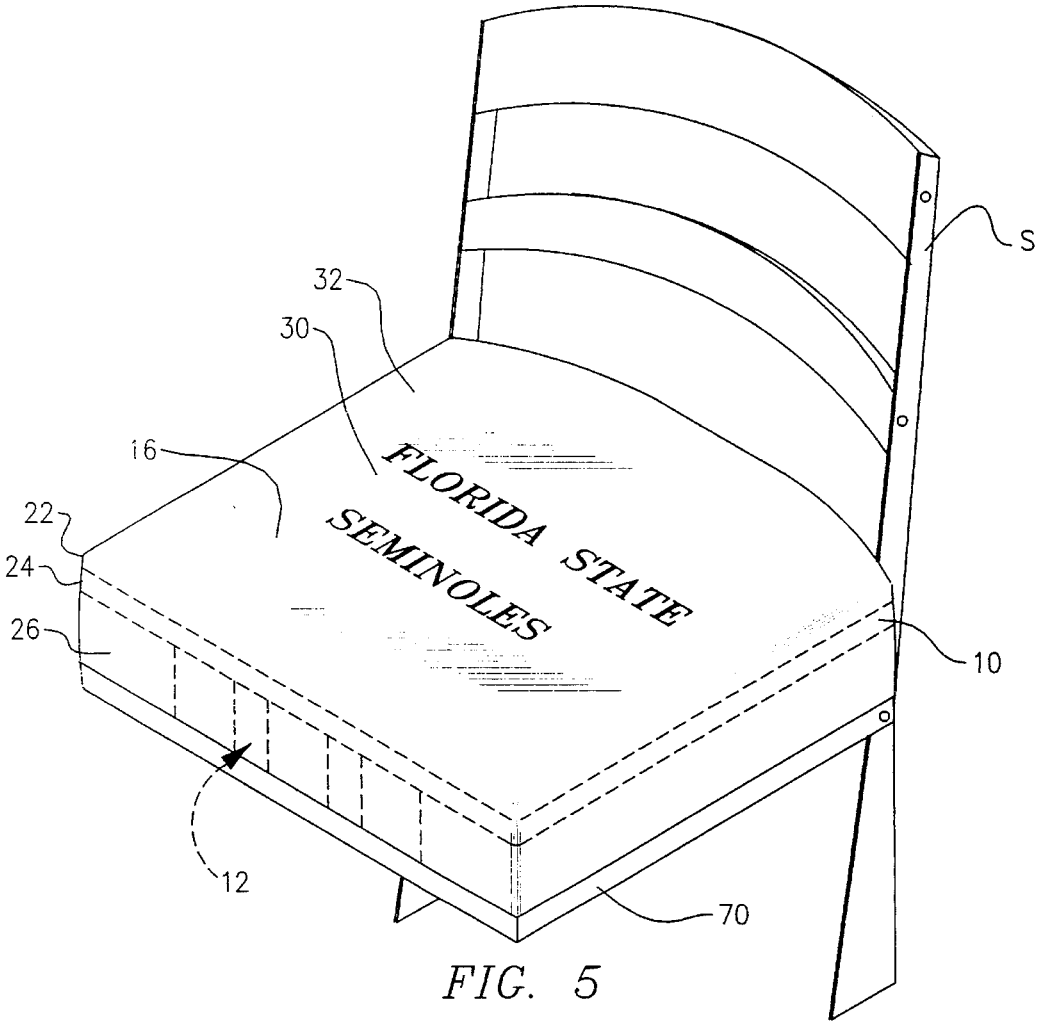
FIG. 5 is a perspective view of the seat cushion apparatus as applied to a stadium seat/bench.

Cushion apparatus 10 is used to provide cushioning for seat S in the manner illustrated in FIG. 5. In particular, apparatus 10 is engaged with seat S such that the surface 14 (see FIG. 2) of apparatus 10 engages the rigid, generally horizontal seat surface 70 of seat S. Receptacles 12 face downwardly toward seat surface 70. Cushion surface 16 faces upwardly to provide the user with a cushioned seating surface. When the spectator sits upon cushion apparatus 10, the padded sections 20 and 22 intermediate support element 24 provide a supportive, yet cushioned seat surface that is comfortable for extended periods of time such as the duration of a sporting event, concert or stadium activity. As previously described, appropriate indicia is printed on the inner fabric covering 30 and is visible through the transparent outer sheet 32. Various other indicia may be carried on the reverse surface 14 and side edges of the cushion apparatus 10. Curved edge 27 is designed to mate with a curved seat back. However, the cushion works equally well with backless seating such as bleacher seats.

Apparatus 10 is converted into a refreshment accommodating tray, in the manner shown in FIG. 6, by simply lifting cushion apparatus 10 from the seat and inverting it so that receptacles 12 face upwardly. After the spectator has made purchases from a concession stand or vendor, various food and beverage items are placed in respective receptacles. For example, a cup 80 is snugly received in receptacle 40 and a can 82 is similarly received in receptacle 44. A bag of popcorn 84 is inserted into relatively wide section 50 of receptacle 36 and a box of candy 86 is held in relatively narrow section 52 of receptacle 36. It will be obvious that numerous other sizes, shapes and arrangements of liquid and food refreshments may be placed within receptacles 12. The resilient foam material that defines the receptacles provides for an adjustable snug fit so that many shapes and sizes of containers may be securely held in apparatus 10. After the refreshments are placed into receptacles 12, the user grasps the inverted cushion proximate its edges and carries it back to his seat.

Apparatus 10 serves as a strong and supportive tray which enables refreshment items to be carried back to the spectator's seat without spilling. The plastic covering resists stains and damage if some refreshment is accidentally spilled. After returning to his or her seat, the user may place the cushion/tray 10 on his or her lap or on an adjacent seat so that the refreshment items continued to be securely held. The rugged construction and, in particular, the use of internal support element 24 strengthens the cushion apparatus and helps prevent it from bending or collapsing, even under the weight of a number of refreshment items.

In alternative embodiments the support element 24 may be eliminated. In such cases a relatively thick or supportive cushioning material is critical. In these embodiments padded portions 20 and 22 are formed unitarily or glued together. The above described dimensional requirements are particularly important.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A refreshment accommodating seat cushion apparatus for selectively engaging a generally horizontal seat surface to support a person thereon, said apparatus comprising:

means defining a cushion having a pair of opposing first and second facing padded sections;

a relatively rigid support element disposed within said cushion, between said padded sections; and receptacle means formed in said cushion extending exclusively through said first padded section and terminally engaging said support element for accommodating at least one refreshment container, said seat cushion being selectively engaged with the generally horizontal seat surface such that said first padded section faces and touches the seat surface and the other said padded section faces upwardly from the seat surface.

2. The apparatus of claim 1 in which each padded section comprises a resilient substance.

3. The apparatus of claim 1 in which each said padded section comprises a closed cell foam element.

4. The apparatus of claim 3 in which said cushion further includes means defining a flexible covering formed over said padded sections.

5. The apparatus of claim 4 in which said flexible covering lines said receptacle means.

6. The apparatus of claim 4 in which said flexible covering comprises a fabric.

7. The apparatus of claim 4 in which said flexible covering includes a liquid resistant sheet.

8. The apparatus of claim 7 in which said liquid resistant sheet includes indicia printed thereon.

9. The apparatus of claim 4 in which said covering includes an inner fabric and an outer liquid resistant sheet.

10. The apparatus of claim 9 in which said fabric includes indicia printed thereon and said liquid resistant sheet is transparent to permit viewing of said indicia.

11. The apparatus of claim 1 in which said support element includes a generally planar configuration.

12. The apparatus of claim 1 further including means defining a handle that is attached to and distinct from said cushion.

13. The apparatus of claim 1 in which said receptacle means extend completely through said first padded section.

14. The apparatus of claim 1 in which said support element defines an inner end of said receptacle means.

15. The apparatus of claim 1 in which said support element is comprised of a rigid inner element and a sheet material that covers said inner element.

16. A refreshment accommodating seat cushion for selectively engaging a generally horizontal seat surface to support a person thereon, said apparatus comprising:

means defining a cushion having a pair of opposing first and second facing padded sections; said cushion having a thickness of at least 2½ inches;

a relatively rigid support element disposed within said cushion, between said padded sections; and receptacle means formed in said cushion, extending exclusively through said first padded section and terminally engaging said support element for accommodating at least one refreshment container when said first padded section is disengaged from said horizontal seat surface; said second padded section being solid and lacking receptacles; said receptacle means extending completely through said first padded section and said support element defining an inner end of said receptacle means; said receptacle means including at least one cylindrical section that has a depth of at least 1½ inches and said second padded section having a thickness of at least 1 inch; said seat cushion being selectively engaged with the generally horizontal seat surface such that said first padded section faces and touches the seat surface and the other padded section faces upwardly from the seat surface.

17. The apparatus of claim 16 in which said support element is comprised of a rigid inner element and a sheet material that covers said inner element.

* * * * *